US008820507B2

(12) United States Patent
Baudat

(10) Patent No.: US 8,820,507 B2
(45) **Date of Patent: *Sep. 2, 2014**

(54) CURRENCY DISCRIMINATION AND EVALUATION

(71) Applicant: MEI, Inc., Malvern, PA (US)

(72) Inventor: Gaston Baudat, Glenmoore, PA (US)

(73) Assignee: MEI, Inc., Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/953,672

(22) Filed: Jul. 29, 2013

(65) Prior Publication Data

US 2013/0341154 A1 Dec. 26, 2013

Related U.S. Application Data

(63) Continuation of application No. 13/122,249, filed as application No. PCT/US2009/059354 on Oct. 2, 2009.

(60) Provisional application No. 61/102,685, filed on Oct. 3, 2008.

(51) Int. Cl.
*G07F 7/04* (2006.01)

(52) U.S. Cl.
USPC ..... 194/206; 194/302

(58) Field of Classification Search
USPC ..... 194/206, 207, 302, 317–320; 209/534; 73/514.14; 324/657, 662
See application file for complete search history.

(56) References Cited

U.S. PATENT DOCUMENTS

| | | | | |
|---|---|---|---|---|
| 4,577,744 | A * | 3/1986 | Doucet | 194/318 |
| 4,601,380 | A * | 7/1986 | Dean et al. | 194/318 |
| 5,213,190 | A * | 5/1993 | Furneaux et al. | 194/317 |
| 5,715,926 | A * | 2/1998 | Furneaux et al. | 194/317 |
| 2004/0050652 | A1 * | 3/2004 | Voser | 194/302 |
| 2005/0198599 | A1 * | 9/2005 | Sercu et al. | 716/4 |

* cited by examiner

*Primary Examiner* — Jeffrey Shapiro
(74) *Attorney, Agent, or Firm* — Mintz Levin Cohn Ferris Glovsky and Popeo, P.C.

(57) ABSTRACT

The disclosure relates to modeling the structure of an item of currency and to predicting the behavior of a currency sensing system as related to the structure of a tested item of currency. For a specified set of parameters of an item of currency, the response of the currency sensing system can be predicted. A particular construction of an item of currency can be determined based on theoretical responses from the item of currency being tested with a theoretical currency sensing system.

13 Claims, 10 Drawing Sheets

60
65
63
wire
$r_1$
$r_2$
$L$ = height
$l_1$ = lift off
$(\mu_M, \sigma_M)$
$(\mu_n, \sigma_n)$
$(\mu_2, \sigma_2)$
$(\mu_1, \sigma_1)$
Layer $M$
Layer $n$
Layer 2
Layer 1
0
$z_n$
$z_2$
$z_1$
Depth [m]
50

CURRENCY DISCRIMINATION AND EVALUATION

CROSS REFERENCE TO RELATED APPLICATIONS

This application is a continuation application of U.S. patent application Ser. No. 13/122,249 filed Jun. 3, 2011, which claims the benefit of PCT Application No. PCT/US2009/059354, filed on Oct. 2, 2009, which claims priority from U.S. Provisional Application No. 61/102,685, filed Oct. 3, 2008, the contents of each are incorporated in their entirety herein by reference.

FIELD OF DISCLOSURE

The disclosure relates to a method for modeling the structure of an item of currency. In particular, the disclosure relates to a method for predicting the behavior of a currency sensing system as related to the structure of a tested item of currency. The disclosure also relates to a sensing apparatus used for sensing characteristics of an item of currency.

BACKGROUND

Automated transaction machines (e.g. vending machines, gaming machines, ATMs, etc.) typically accept items of currency in exchange for goods and/or services. Items of currency are typically inserted into an automated transaction machine, and are evaluated by an authentication unit to determine if they are genuine or non-genuine. In some forms of currency (e.g. banknotes) there can be inks used for printing images and other features deemed necessary by a respective banking authority. It is known that some inks used for printing can exhibit electromagnetic properties such that a sensing system can be used to verify its presence or characteristics. Banknotes are sometimes constructed using multiple layers of different materials to form a substrate. In some cases one or more of these layers exhibit electromagnetic properties such that a sensing system can be used to verify its presence or characteristics.

Other items of currency (e.g. coins or tokens) can be constructed using at least one component or material that exhibits electromagnetic properties. Some currently circulating coins are constructed using more that one material (e.g. cladded coins, platted coins, or bi-color coins), and in some cases at least one of the materials used exhibit electromagnetic properties. In automated transaction machines, there can be provided a sensing unit that is capable of verifying the presence or characteristics of a given material in an item of currency. For the purposes of the disclosure the term "item of currency" includes, but is not limited to, banknotes, bills, coupons, security papers, checks, valuable documents, coins, tokens, and gaming chips.

The authentication of items of currency can also occur in processing equipment used by central banking institutions for sorting and evaluation. This equipment can include an authentication unit configured to sense at least one electromagnetic property of an item of currency for the purpose of recognition and/or authentication.

SUMMARY

Various aspects of the invention are set forth in the claims.

In some implementations there can be provided a method for predicting the response from an item of currency when using a specified currency sensing system. There can be provided a mathematical model of an item of currency and a mathematical model of a given sensing system such that for a specified set of parameters of an item of currency, the response of the specified currency sensing system can be predicted.

In some implementations, there can be provided a method for determining a particular construction of an item of currency based on theoretical responses from such an item of currency being tested with a theoretical sensing system. In some implementations, there can be provided a method and system for determining the structure of an item of currency based on theoretical responses of such an item of currency being evaluated by a theoretical sensing system and further based on a set of known items of currency.

DETAILED DESCRIPTION OF THE DISCLOSURE

In some implementations there can be provided a method of predicting the response of a specified currency sensing system for a given inputted set of parameters of an item of currency. More particularly, an item of currency can be constructed using at least one component (e.g. material layer) exhibiting electromagnetic properties. In some implementations, there can be a mathematical model of an item of currency such that at least one component of an item of currency can be described relative to its respective electromagnetic properties. It is possible that for a specific item of currency there can be a plurality of components (e.g. 3 layers) exhibiting electromagnetic properties. With an item of currency having a plurality of layers, each layer can be inspected to determine the material thickness and type. In some implementations, the inductance relative to frequency can be used to characterize at least one electromagnetic component present in an item of currency. In some implementations, an item of currency can be characterize by a complex impedance measurement (or estimation) relative to frequency when being evaluated (i.e. sensed) by a Pulse Eddy Current (PEC) sensing system.

Figure 1:
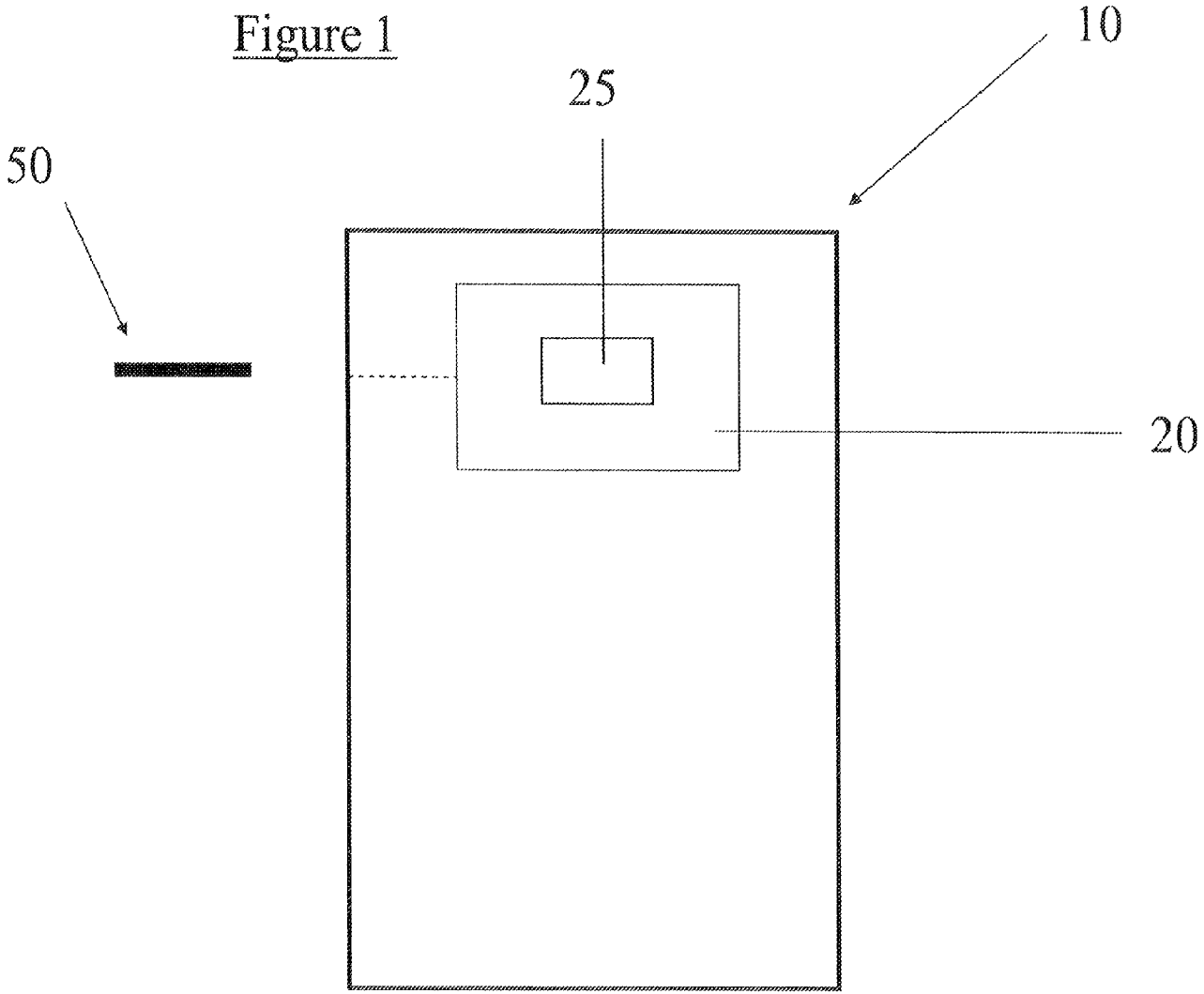
FIG. 1 illustrates a currency handling machine including various aspects of the invention.

FIG. 1 shows a currency handling machine (i.e. automated transaction machine) 10 including an authentication device 20. An item of currency 50 can be inserted into currency handling machine 10 and transported to authentication device 20 as is commonly known in the arts. Authentication device 20 inspects (or senses) inserted item of currency 50 using a sensing system 25. Sensing system 25 can employ a variety of sensing techniques known in the arts (e.g. using a PEC sensor) for obtaining response information (i.e. data) about the currency item 50. In some implementations, the response information obtained by authentication device 20 is used to characterize at least one electromagnetic component of currency item 50.

In some implementations, currency handling machine 10 includes a sensing device 25 including a PEC sensor 60. PEC sensor 60 can be arranged to include input 61, a coil 63, core 65, and output 68 as is commonly known in the arts. In some implementations input 61 can be configured to use broad band techniques for driving PEC sensor 60. In other implementations, input 61 can be configured to use other techniques (e.g. spread spectrum, frequency hopping) for driving PEC sensor 60.

In some implementations, the input 61 and output 68 of coil 63 can be used as inputs to a model (e.g. Equation (A)) to obtain electromagnetic properties of at least one material (i.e. component) of currency item 50. The material properties obtained from the model can then be used as inputs to a classification technique (e.g. Mahalanobis Distance, Linear Discriminant Analysis, Feature Vector Selection) to obtain statistical information on item of currency 50 relative to at least one known other item of currency (e.g. other classes, forgeries, other denominations). In other implementations, the sensing system 25 is arranged such that a numerical solution of the Maxwell equations are required in order to obtain the material properties of currency item 50. In such implementations, the material properties can be used as inputs to a classification technique or algorithm (e.g. Mahalanobis Distance, Linear Discriminant Analysis, and Feature Vector Selection).

In some implementations there can be provided a sensing system 25 configured to discriminate and/or classify an item of currency 50. Sensing system 25 can be arranged to include a processing unit 80 for driving the input 61 and receiving signals at output 68. In some implementations, sensing system 25 includes a memory unit 90 electrically coupled to processing unit 80. In some implementations, processing unit 80 is arranged as a component of authentication device 20 and electrically coupled to sensing system 25. In other implementations, processing unit 80 is integrated as a component of sensing system 25. Either arrangement is not intended to be a limitation of the scope of the disclosure.

Processing unit 80 uses the signals of input 61 and output 68 and a specified model (e.g. Equation (A)) to compute material properties of currency item 50. Processing unit 80 can be further configured to use the computed material properties of currency item 50 as inputs to a classification algorithm in order to discriminate or classify item of currency 50 from at least one other known item of currency. For example, authentication device 20, can be arranged to accept $1, $5, $10, and $20 US banknotes. In such an implementation, currency item 50 is evaluated by authentication device 20 and processing unit 80 can be arranged to determine if currency item 50 belongs to one of the aforementioned US denominations (i.e. classes). In some implementations, other classes can be used including, but not limited to, genuine, non-genuine, fit for circulation, not fit for circulation or any other class as required for the given application for authentication unit 20.

Figure 2:
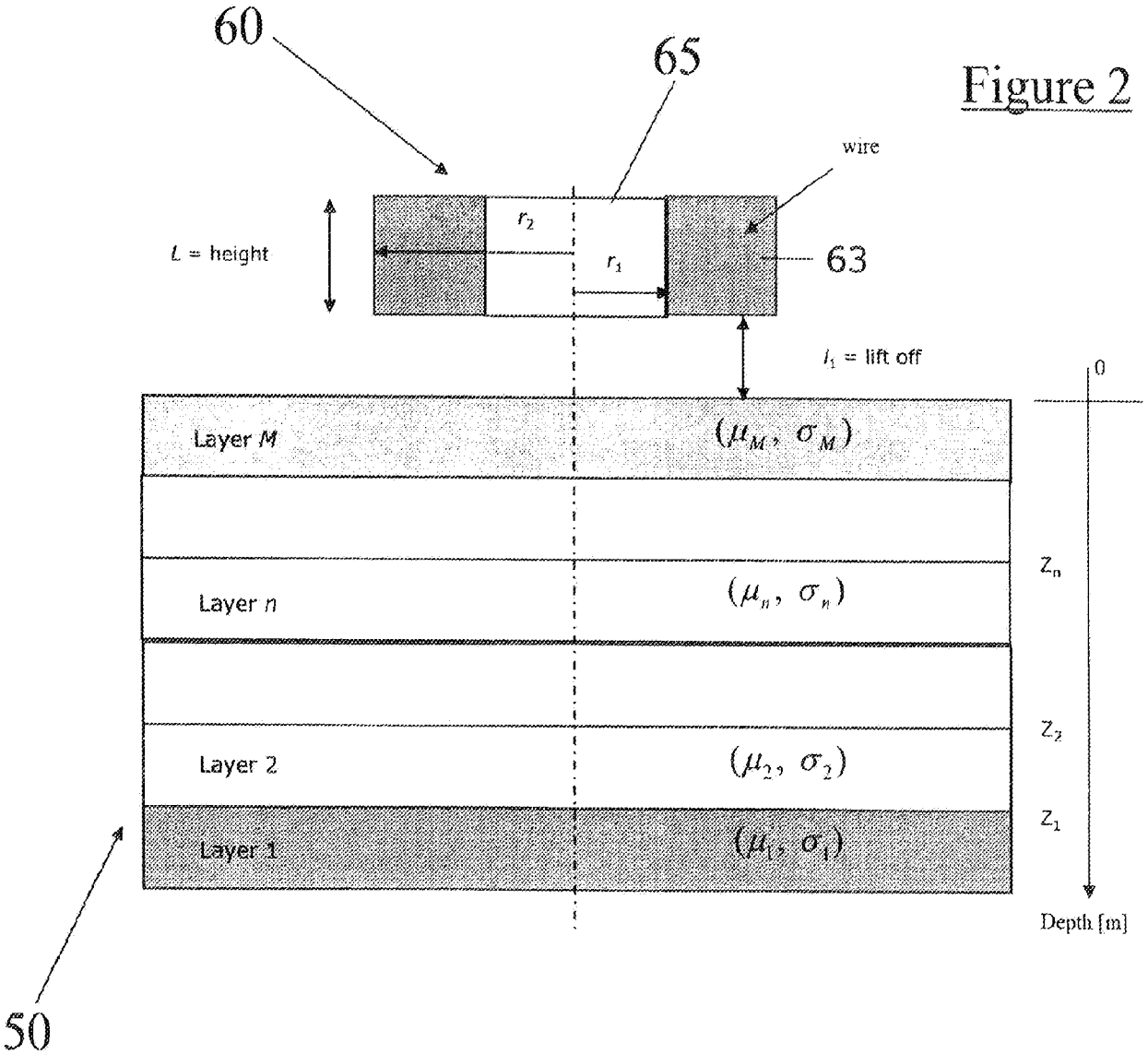
FIG. 2 illustrates a sensor 60 and an item of currency 50 structure having a plurality of material layers according to various implementations of the disclosure.

Using the example of a sensing device 25 configured for employing a PEC sensor 60, the structure of an item of currency can be estimated. FIG. 2 shows sensor 60 and an item of currency 50 having a plurality of electromagnetic layers. If the size of sensor 60 is small in comparison to the size of an item of currency 50, it can be assumed that each layer is an infinite plane of material, and thus the edge effects of each layer can be neglected.

Solving Maxwell equations, a particular model can be created for a specified sensing system. For example, the complex impedance Z(ω), represented by equation (A), can be used.

Equation (A)

$$Z(\omega) = j\omega K \int_0^{+\infty} \frac{P^2(r_1, r_2)}{\alpha^5}\left(2L + \frac{1}{\alpha}\left[2e^{-\alpha L} - 2 + A(\alpha)\frac{U_{12}}{U_{22}}\right]\right)d\alpha$$

where:

1) $K = \frac{\pi\mu_0 N^2}{L^2(r_2 - r_1)^2}$

2) $\mu_0 = 4\pi 10^{-7} H/m$

3) $P(r_1, r_2) = \int_{\alpha r_1}^{\alpha r_2} x J_1(x)\,dx$

4) $A(\alpha) = (e^{-\alpha L} - 1)^2 e^{-2\alpha l_1}$

5) $\omega = 2\pi f$

6) $H_n =$ $$\frac{1}{2}\begin{bmatrix} (1+\beta_n)e^{(\alpha_{n+1}-\alpha_n)z_n} & (1-\beta_n)e^{(\alpha_{n+1}+\alpha_n)z_n} \\ (1-\beta_n)e^{-(\alpha_{n+1}+\alpha_n)z_n} & (1+\beta_n)e^{-(\alpha_{n+1}-\alpha_n)z_n} \end{bmatrix}$$

7) $\beta_n = \frac{\mu_{n+1}}{\mu_n}\frac{\alpha_n}{\alpha_{n+1}}\ \alpha_n\sqrt{\alpha^2 + j\omega\mu_n\sigma_n}$ 8) $U = H_{M-1}H_{M-2} \ldots H_n \ldots H_2 H_1$ It should be understood that for other types of sensing system (i.e. sensor configurations), a different model can be established by solving the Maxwell equations (as commonly known is the arts) given the particular constraints of such a sensing system (e.g. different coil geometries). Alternatively, where a model from solving the Maxwell equations is not practical, the Maxwell equations themselves can be numerically solved. In equation (A) $J_1(x)$ is the Bessel function of the first kind, first order. $U_{12}$ is the first line, second column of the matrix U, and $U_{22}$ is its the second line, second column and f is the frequency. In addition, $\mu_n$ is the $n^{th}$ material layer permeability [H/m], and $\sigma_n$ its associated conductivity [S/m]. Finally N is the amount of turn for the coil wire.

If the first layer of equation (A) is assumed to have an infinite thickness, it can be thought of as acting as a half space. Choosing $\mu_1=1$ and $\sigma_1=0$, the first layer of currency item 50 becomes air like. Equation (A) is an exact mathematical solution for an air-core coil for sensor 60. If the coil is inside of a ferrite pot, equation (A) still can be used as a good approximation, assuming $\mu_0$ and coil 65 geometrical dimensions are changed accordingly to fit the actual coil impedance. For example, this can be accomplished by trial and error in a known situation until a good fit has been reached.

Using an example sensing system 25 having a sensor 60 (as shown in FIG. 2), the application of high frequencies to sensor 60 can result in the skin effect of coil 65 to become significant and thus a correction of the DC wire resistance can be computed to correct such and effect as commonly known in the arts. Similar techniques can be applied to stray capacitance. For example, stray capacitance can be modeled as a parallel parasitic capacitor as commonly known in the arts.

In some implementations, differential impedance $\Delta Z(\omega)$, rather than the absolute one $Z(\omega)$ can be used. Such an approach can be used to remove the effect of the sire resistance and other common factors (e.g. temperature drift). The differential impedance can be represented by equation (B).

$$\Delta Z(\omega)=Z_{coin}(\omega)-Z_{air}(\omega) \quad \text{Equation (B)}$$

In an example of an implementation, item of currency 50 is a multi-layer coin. In equation (B), $Z_{air}(\omega)$ corresponds to the situation where there is no coin 50 near sensor 60, while $Z_{coin}(\omega)$ corresponds to the situation having coin 50 present. $Z_{air}(\omega)$ is computed just before processing coin 50, for example as an idle background processor task of sensing system 25. In such an example, $Z_{air}(\omega)$ is an estimation at the current system temperature and set up of sensing system 25.

To illustrate the technique of the disclosure, and example will now be described. It should be understood however, that the following example is an example implementation, and in no way is intended to be limiting on the scope of the disclosure or claims.

Figure 3:
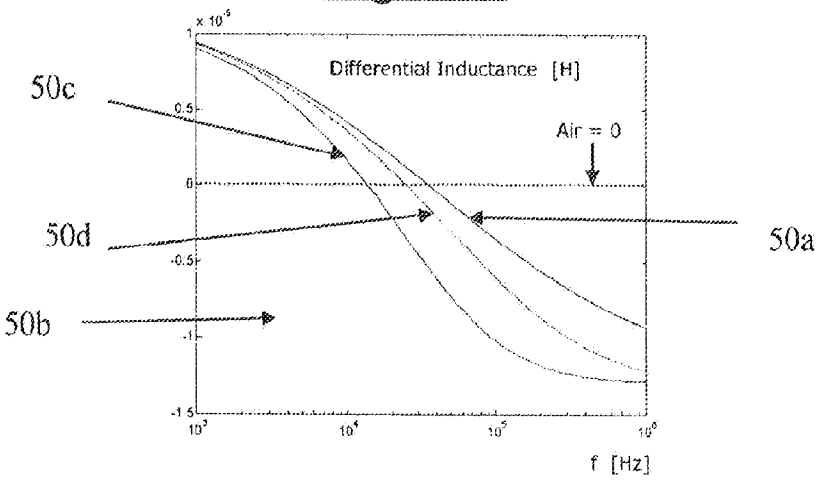
FIG. 3 illustrates a plot of the differential inductance of various items of currency as a function of frequency.

FIG. 3 shows the output from sensing system 25 including a PEC sensor 60 for four test coins 50*a-d* as the differential impedance in relation to frequency. In the currency example, sensor 60 includes a core 65 made of steel. The four test coins are 50*a* (one layer steel coin), 50*b* (one layer copper coin), 50*c* (20 μm copper over a steel core), and 50*d* (5 μm copper over steel core). Inspection of FIG. 3 shows that each coin 50*a-d* respectively, exhibit similar differential impedance's at lower frequencies and markedly different impedance's for higher frequencies.

The differential impedance of equation (B) is a complex function and therefore can be split into two terms. In an implementation of the disclosure, the differential impedance can be investigated using an inductive part $\Delta L(\omega)$ and a resistive part $\Delta R(\omega)$. Each can be represented by equations (C) and (D) respectively.

$$\Delta L(\omega) = \Delta L(\omega)\frac{\Im\{\Delta Z(\omega)\}}{\omega} \quad \text{Equation (C)}$$

$$\Delta R(\omega) = \Re\{\Delta Z(\omega)\} \quad \text{Equation (D)}$$

Figure 4:
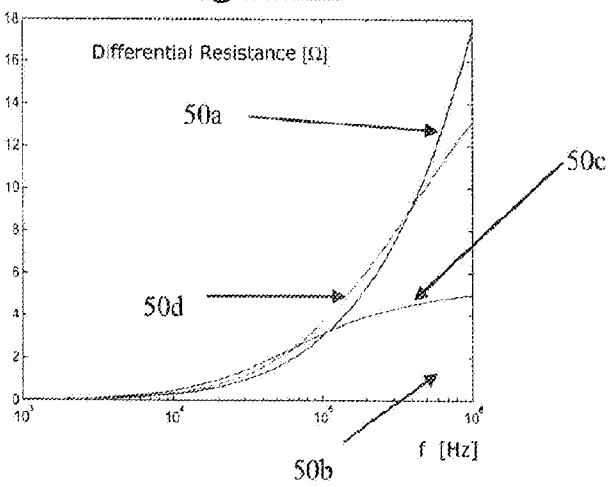
FIG. 4 illustrates a plot of the differential resistance of various items of currency as a function of frequency.

For example, when there is not item of currency 50 (e.g. a two layer coin) in the presence of sensing system 25, $\Delta L(\omega)=\Delta R(\omega)=0\forall\omega\geq 0$. When an item of currency 50 is in the presence of sensing system 25, the system becomes non-linear in which $\Delta L(\omega)$ and $\Delta R(\omega)$ evolve with the pulsation of $\omega$. Such a situation is a result of eddy currents developing inside of each material of currency item 50. For example, in FIG. 3 showing items of currency 50*a-d*, it can be seen that at low frequency a plated steel coin 50*c*, 50*d* (i.e. item of currency) exhibit a response similar to steel only coin 50*a*. Similarly at high frequency plated steel coins 50*c*, 50*d* exhibit a response similar to copper only coin 50*b*. Further inspection shows that a smooth transition region exists, in relation to frequency, from steel to copper. In the example implementation above, FIG. 3 and FIG. 4 show that the transition of a 20 μm copper plated steel coin 50*c* occurs at a lower frequency than that of a 5 μm copper plated steel coin 50*d*.

Figure 5:
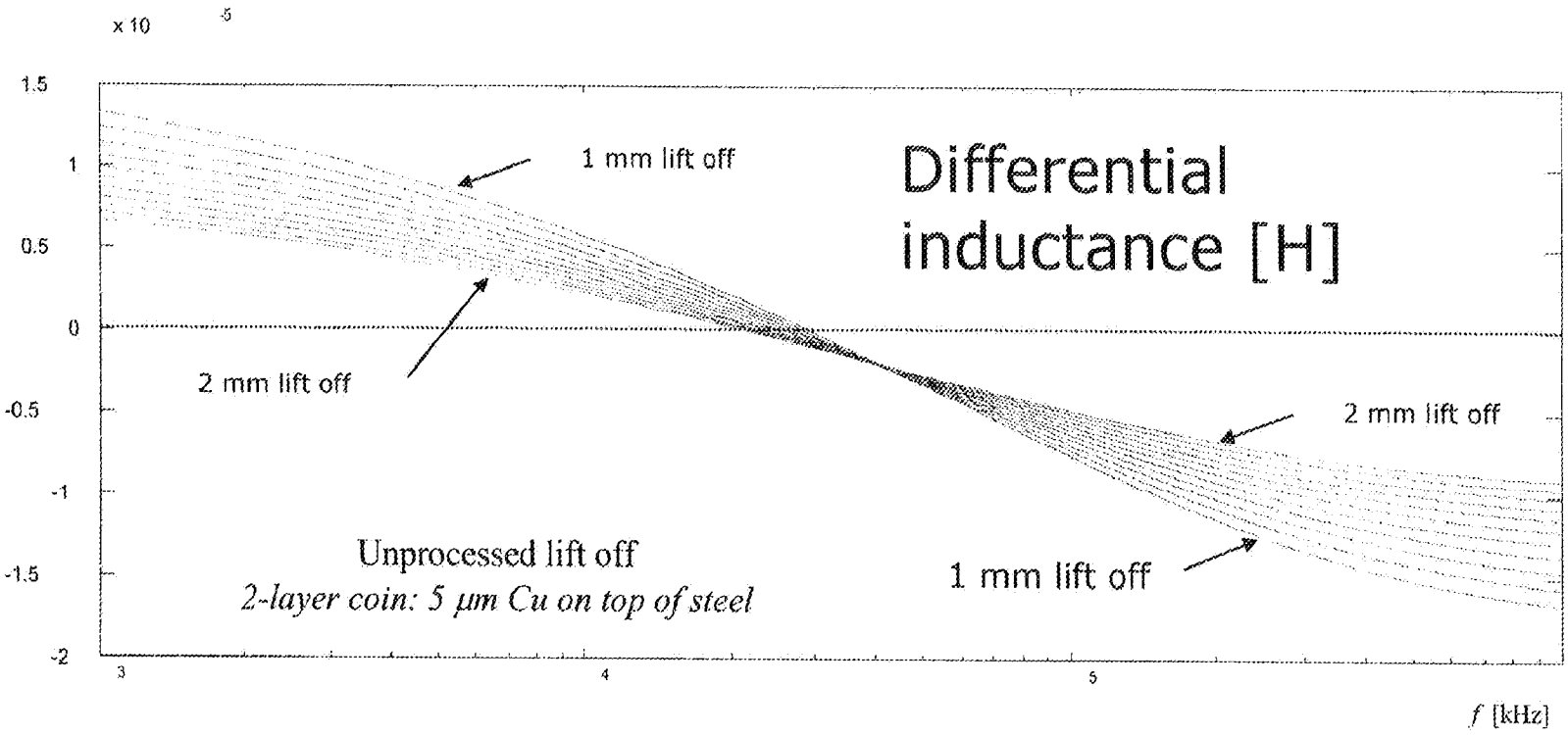
FIG. 5 is a plot of the differential inductance relative to frequency for varying lift off conditions.

In some implementations, it can be necessary to account for the distance between sensor 60 and an item of currency 50. For example, in the example described and shown in FIG. 2, the distance $l_1$ is the distance between sensor 60 and an item of currency 50 and can be referred to as lift off as commonly known in the arts. FIG. 5 shows the differential inductance in relation to frequency for an item of currency (e.g. 5 μm copper plated steel coin 50*d*) with varying lift off between 1 mm and 2 mm. It can be seen that there is clearly one frequency $f_\theta$ for which all curves cross at nearly the same value of zero. The frequency $f_\theta$ is a function of a given material and thickness of a specific layer. Assuming that the differential inductance's $\Delta L(\omega)$ belong to the same function family, and that they only differ by a factor, Equation (E) can be used to correct for the lift off.

$$\Delta L_{corrected}(\omega) = \frac{\Delta L(\omega) - \Delta L(2\pi f_\theta)}{\Delta L_0} \quad \text{Equation (E)}$$

where: where $\Delta L_0$ could be chosen among different definitions, such as:

$$\Delta L_0 = \Delta L(\omega_0) - \Delta L(2\pi f_\theta) \quad \text{E(a)}$$
$$\omega_0 \neq 2\pi f_\theta$$

$$\Delta L_0 = \frac{1}{\omega_2 - \omega_1}\int_{\omega=\omega_1}^{\omega=\omega_2}[\Delta L(\omega) - \Delta L(2\pi f_\theta)]\,d\omega \quad \text{E(b)}$$
$$\omega_2 \neq \omega_1$$

Or the simplification, for small $\theta$:

$$\Delta L_0 = \frac{1}{\omega_2 - \omega_1}\int_{\omega=\omega_1}^{\omega=\omega_2}\Delta L(\omega)\,d\omega \quad \text{E(c)}$$
$$\omega_2 \neq \omega_1$$

From the above set of equations and definitions, a simplified version of Equation (E) can be represented by equation (F).

$$\Delta L_{corrected}(\omega) = \frac{\Delta L(\omega)(\omega_2 - \omega_1)}{\int_{\omega=\omega_1}^{\omega=\omega_2}\Delta L(\omega)\,d\omega} \quad \text{Equation (F)}$$
$$\omega_2 \neq \omega_1$$

Figure 6:
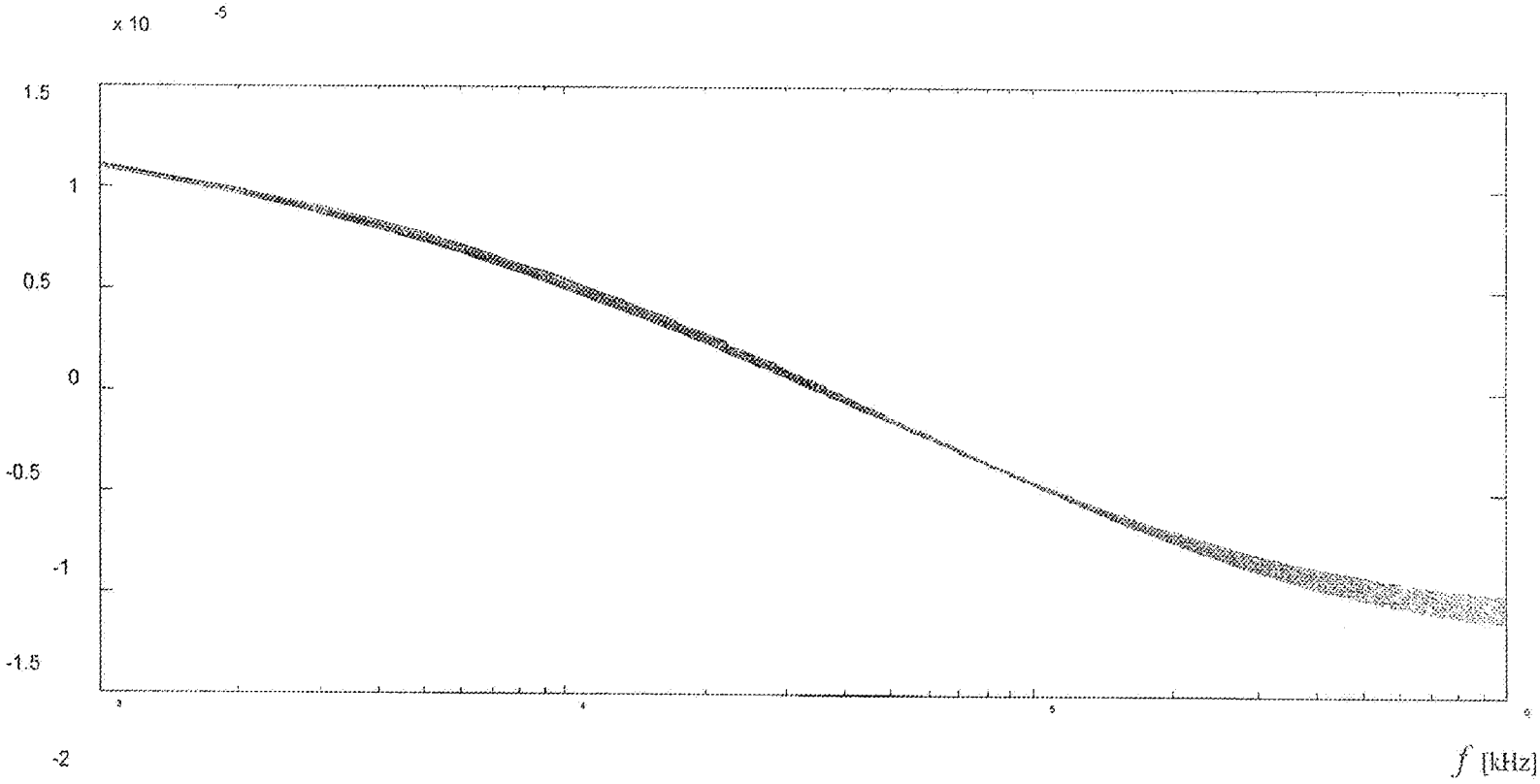
FIG. 6 is a plot of the differential inductance relative to frequency having been corrected for various lift off conditions.

FIG. 6 shows the results for compensating for the lift off factor using equation (E) and definition E(b).

In some implementations, the structure of an item of currency 50 can be further estimated using Model inversion techniques as commonly known in the arts. Applying such techniques to equation (A) and/or equation (B) allows for the estimation of the structure of an item of currency 50 from experimental data. As an example, inversion of $Z(\omega)$ will now be described, although it is not intended as a limitation of the disclosure. For example, a similar process can be used for $\Delta Z(\omega)$ without varying in scope from the present disclosure.

In the present example, experimental data is gathered from an item of currency 50 (e.g. coin or banknote) using swept frequency techniques, direct signal spread spectrum, or any suitable signals. Furthermore, in the current example the frequency domain will be focused on, however the same procedure can be used for the time domain using the inverse Fourier Transform. Once experimental data is obtained for an item of currency 50, an estimation of the coil impedance $\hat{Z}(\omega)$ can be obtained. This can be accomplished using a non-parametric approach such as Fast Fourier Transform (FFT) or by a parametric approach such as ARMAX. In the present example, the inversion can be viewed as a non-linear regression. In order to accomplish this, the empirical risk (equation (F)) associated with a pointwise loss function (equation (G)) need to be minimized.

$$L(\vec{\theta}, Z(\omega)) = \|\hat{Z}(\omega) - Z(\omega)\|^2 \quad \text{Equation (F)}$$

$$R_{emp}(\vec{\theta}) = \frac{1}{M}\sum_{k=1}^{M} L(\hat{Z}(\omega_k), \omega_k, Z(\omega_k), \vec{\theta}) \quad \text{Equation (G)}$$

In the above equations (F) and (G), M is the amount of samples and $\vec{\theta}$ is the parameter vector, where $\vec{\theta}$ regroups all the unknown values, which can each be layer characteristics $\mu_n$, $\sigma_n$, $z_n$, as well as the lift off and the geometry of coil 65 if no prior knowledge is available. Therefore the inversion solution can be represented by equation (H).

$$\min_{\vec{\theta}} R_{emp}(\vec{\theta}) \quad \text{Equation (H)}$$

Equation (H) is a classical unconstrained least mean square (LMS) optimization, however other optimization techniques known in the arts can be used. For example, inversion techniques can include constraints and regularization since inversion problems are often ill posed, especially in a noisy condition.

In some implementations, classification of an item of currency can be made using a simpler approximation of $Z(\omega)$ (or $\Delta Z(\omega)$) which avoids the inversion of equation (A). For example, ARMAX or OE error or any other known model for retrieving $\hat{Z}(\omega)$ can be used. Although the aforementioned models are linear, by increasing their orders (i.e. poles and zeros) they can fit more complex functions and therefore give a reasonable approximation of $Z(\omega)$.

In some implementations, the coefficients of the model can be used as inputs for recognition and/or classification. In other implementations, a spectral version of $\hat{Z}(\omega)$, either from the above models or an FFT, can be used. In such implementations, it may be important to select the most relevant frequencies, to reduce the amount of computation based on the performance requirements of authentication device 20 (e.g. processing time or acceptance/rejection rates).

In some implementations of the disclosure, there can be provided a method of using currency item 50 modeling techniques as described above in conjunction with modeling of an electromagnetic sensing system 25 for predicting the complex impedance $Z(\omega)$ and/or differential impedance $\Delta Z(\omega)$. In such implementations, by specifying (or proposing) a structure for a given (or theoretical) item of currency 50, a theoretical differential impedance $\Delta Z(\omega)$ can be estimated. By using known Finite Element modeling techniques, the differential impedance $\Delta Z(\omega)$ (or $Z(\omega)$) can be estimated for any hypothetical item of currency. In other implementations where sensing system 25 is arranged such that model inversion is impractical, the estimated material properties can be obtained from directing solving the Maxwell equations given the constraints of the sensing system 25.

In some implementations there can be provided a method of estimating (i.e. predicting) how a proposed or new item of currency 50 structure would be sensed by a specific sensing system 25. More particularly, it is contemplated that using the methods of the disclosure one could estimate if a proposed structure (e.g. 5 layer coin of varying materials) would be sensed, and thus classified) as an already known (and possibly circulating) item of currency or any other class of item as relevant to the specific application of an authentication device 20. Such an analysis can provide a useful tool in developing new items of currency such that the probability of a newly designed item of currency being classified as another item of currency (or as a known forgery) is minimized.

Figure 7:
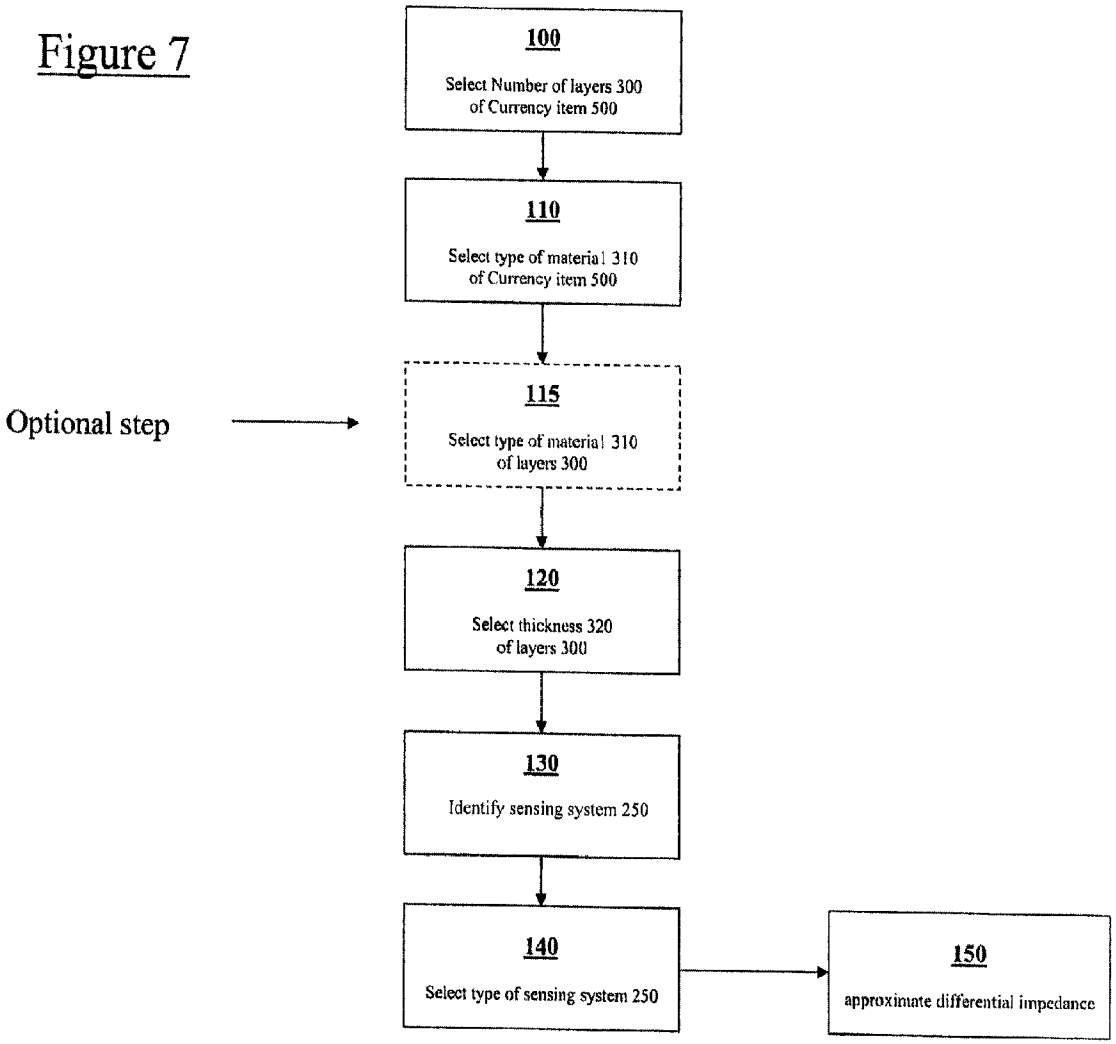
FIG. 7 is a process flow chart showing various steps of the disclosure.

FIG. 7 shows a process flow for an implementation of the disclosure. At step 100 the number of layers for item of currency 500 can be selected. Once the number of layers 300 of currency item 500 are selected, the type of material 310 for each layer 300 (i.e. 300*a*, 300*b*, . . . ) is selected in step 110. It is contemplated that there can be provided a searchable reference list (e.g. database) that can be used or accessed in order to identify relevant material properties (e.g. $\mu_n$, $\sigma_n$, $z_n$) seen from step 115, although this information can be identified manually in step 110. In some implementations, the reference list is stored in memory of authentication device 20. The process continues to step 120 in which the thickness 320 of each layer 300 (i.e. 300*a*, 300*b*, . . . ) is selected. Once the structure of currency item 500 has been established in steps 110 to 120, an identification of the type of sensing system 250 is established in step 130. In some implementations of the disclosure, there is a single sensing system 250 (e.g. PEC) used, however there can be a searchable, or accessible list (e.g. database) of various type of electromagnetic sensing systems that can be selected at step 130.

Having the parameters ($\mu_n$, $\sigma_n$, $z_n$) of a hypothetical currency item 500 identified, along with a specific sensing system 250, an approximation of a differential impedance $\Delta Z(\omega)$ (or any other relevant model of the disclosure) can be computed in step 140. In some implementations, the outcome of the method of the disclosure results in a comparison of the hypothetical item of currency 500 with known items of currency in circulation (or any subset thereof) in step 150. In some implementations, the output results in a set of coefficients from the associated model that can be used with a classification technique to determine how well the hypothetical currency item 500 can be discriminated from known items of currency in optional step 160. In some implementations, the set of coefficients from the associated model can be used with a classification algorithm or fitness function (e.g. Mahalanobis Distance, Feature Vector Selection, Linear Discriminant Analysis, and Support Vector Machine).

Figure 8:
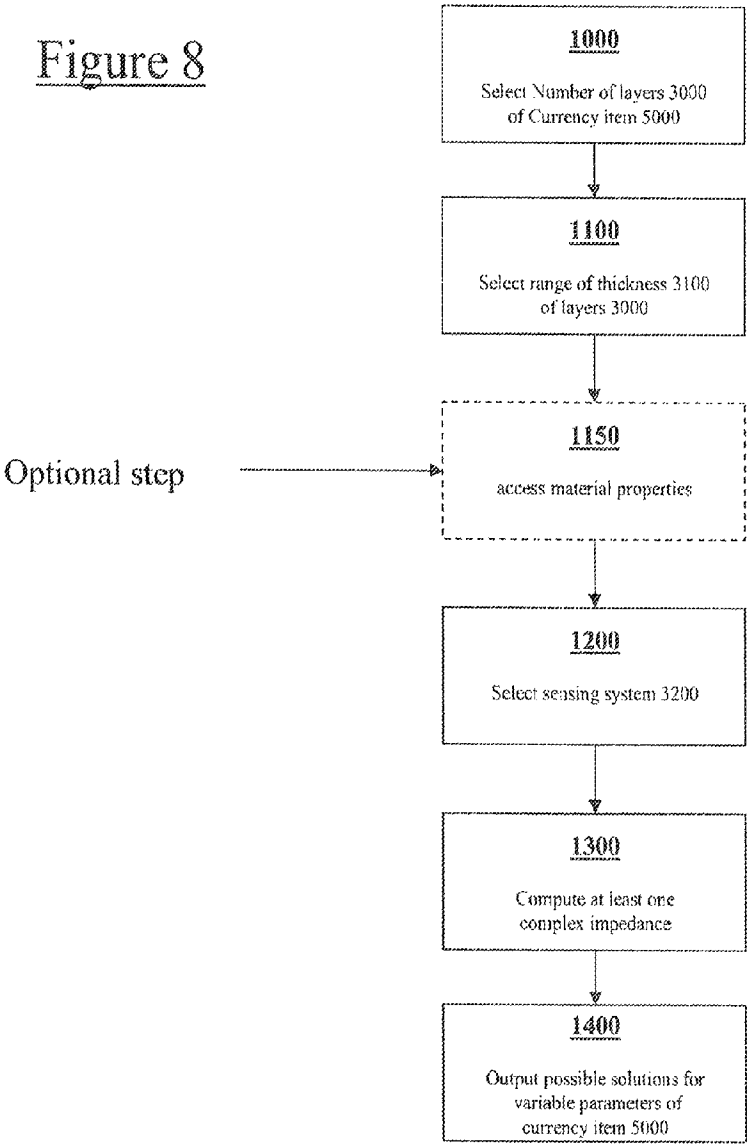
FIG. 8 is a process flow chart showing various steps of the disclosure.

In other implementations, there is provided a method for determining the structure of a new item of currency 5000 based on a differential impedance $\Delta Z(\omega)$ (or any other relevant model of the disclosure) with a given sensing system 1250. FIG. 8 shows a process flow for such an implementation. At step 1000 the number of layers for item of currency 5000 can be selected. At step 1100, a range of thickness 3200 for each material layer selected in step 1000 can be specified. Once the number of layers 3000 of currency item 5000 are selected, and the range of thickness 3200 for each layer 3000 selected in step 1100, the process continues at step 1200. It is contemplated that there can be provided a searchable reference list (e.g. database) that can be used or accessed in order to identify relevant material properties (e.g. $\mu_n$, $\sigma_n$, $z_n$) seen from step 1150. In step 1200, after which the thickness ranges 3200 of each layer 3000 (i.e. 3000*a*, 3000*b*, . . . ) has been selected, an identification of the type of sensing system 2500 is made. In some implementations of the disclosure, there is a single sensing system 2500 (e.g. PEC) used, however there can be a searchable, or accessible list (e.g. database) of various type of electromagnetic sensing systems that can be selected at step 1200.

Having the parameters ($\mu_n$, $\sigma_n$, $z_n$) of a hypothetical currency item 5000 identified, along with a specific sensing system 2500, at least one complex impedance can be computed for the possible configurations of item of currency 5000 by varying each parameter. A proposed solution can be output for a each material layer 3000 based a comparison of the at least one complex impedance of the hypothetical item of currency 5000 and of known items of currency in circulation (or any subset thereof) in step 1400. In other implementations of the disclosure the outcome of the method of the disclosure results is a suggestion (or guidance) of other currency item parameters including, but not limited to number of material layers, type of material, and thickness of material. Such an output is based on the given constraints used (e.g. only 3 layers, or only copper and steel, or any combination of structural characteristics).

In some implementations, the theoretical material properties of currency item (e.g. currency item 5000) obtained from a model inversion are used as inputs to a classification method or algorithm. For example, when the material properties are used as inputs to a classification technique such as Linear Discriminant Analysis (LDA), a statistical separation is obtained from at least one other class of currency items. Other classification techniques can be used including, but not limited to, Mahalanobis Distance Distance, Support Vector Machine, Feature Vector Selection. In order to determine the optimal structure for an item of currency, an optimization technique (gradient distance or a genetic algorithm) can be used to find the optimal statistical separation of currency item 5000 from all other known items of currency (or any subset thereof). For example, if LDA is used a discriminant axis and the distance between an item of currency 5000 and an at least one known item of currency (classes), at least one material property (e.g. material thickness) of currency item 5000 can be varied to determine which value of the material property maximizes the statistical separation of currency item 5000 from the respective known currency items. In such an implementation, a solution can be obtained for the establishment of a new currency item 5000 having at least one material property (e.g. material layer thickness) having been optimized and identified based on finding the maximum statistical separation of currency item 5000 from the known class used. A process flow implementations of the disclosure is shown in FIG. 9.

Figure 9:
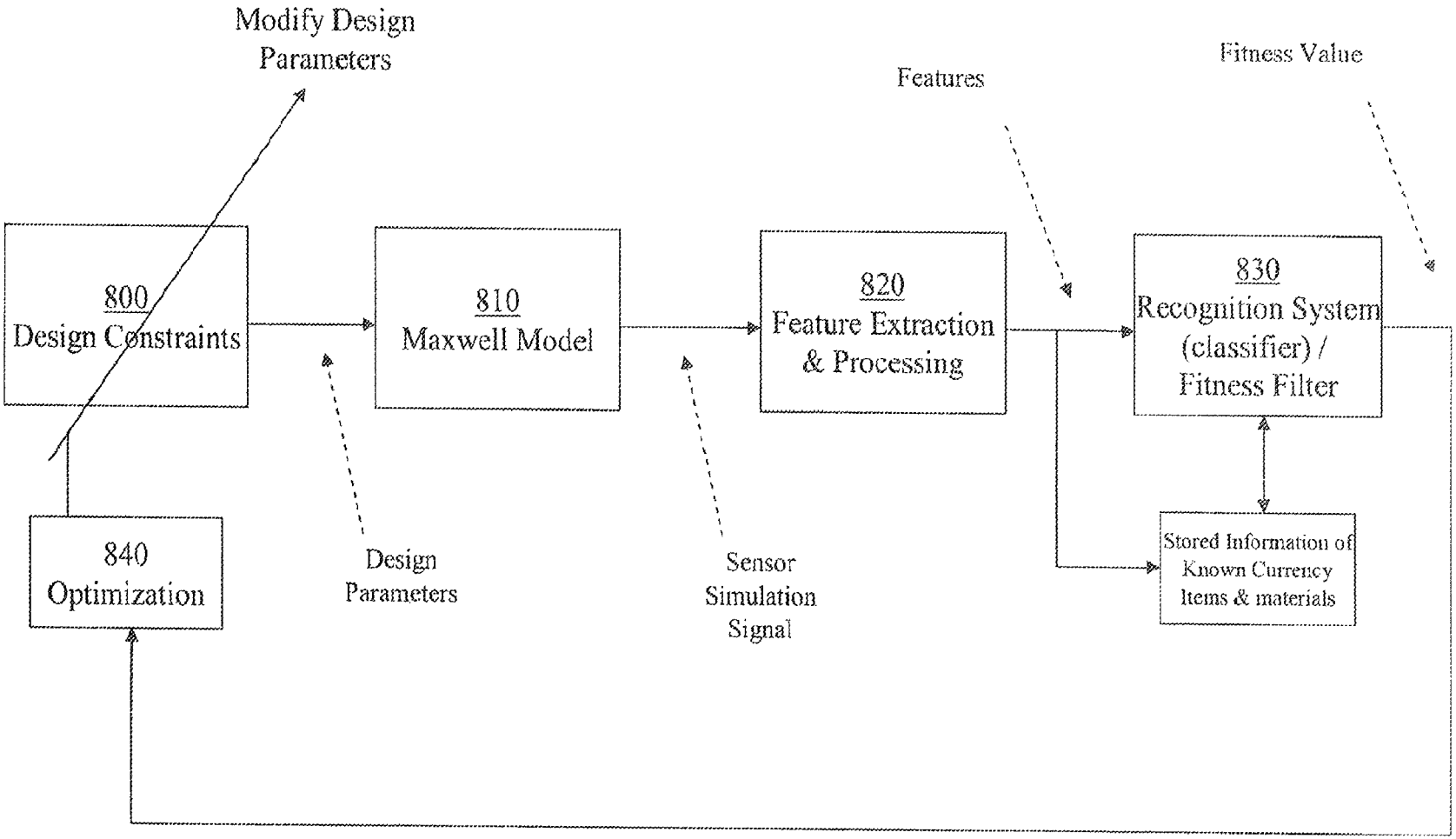
FIG. 9 is a process flow showing various steps of an implementation of the disclosure.
Figure 11:
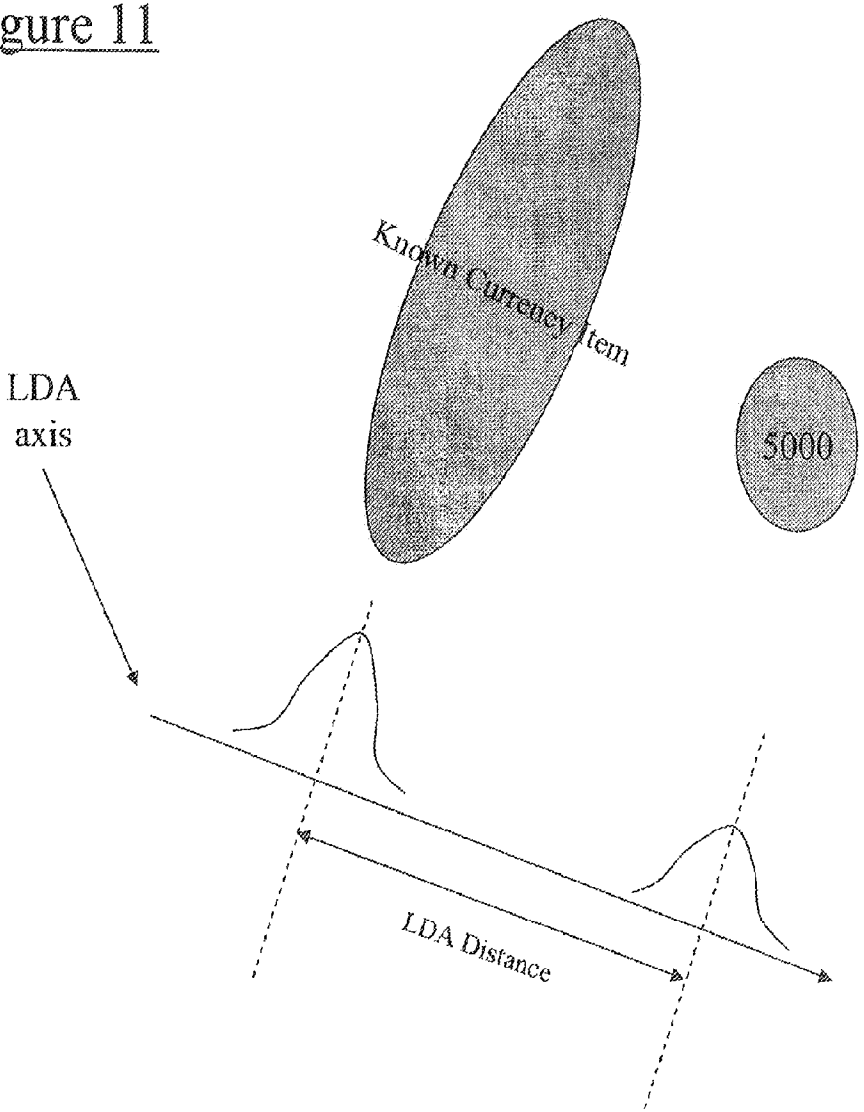
FIG. 11 illustrates a measurement from the Linear Discriminante Analysis (LDA) classification technique.

FIG. 9 shows that design constraints (e.g. material layer thickness, material type, currency item size) can be varied in order to find the optimal structure of an item of currency 5000. As an example of an implementation, a cycle through the process (i.e. method) shown in FIG. 9 will be described. An intitial set of design parameters are established in step 800. For the purposes of the current example, the design parameters fix the size of the item of currency (e.g. a fixed length and width or fixed diameter), a range od the number of layers (e.g. 3), a specified material for each layer (e.g. steel, nickel, and copper), and each material layer can be varied between a specified thickness range (e.g. 5 μm and 20 μm). The selected design parameters are used to solve a Maxwell model 810 (e.g. Equation (A)) to generate simulated sensor signals for an item of currency 5000, having the varying design parameters as described above. The simulated signals from step 810 are then processed by a feature extraction tool 820 (e.g. by processor 80) to extract predetermined features (e.g. peaks and/or lows). The extracted features from step 820 are used as inputs to a recognition process (i.e. a classifier or fitness function) 830. The fitness function from step 830 can be, for example, LDA in which the statistical separation between an item of currency 5000 and at least one known item of currency ($5 US bill) is maximized (shown in FIG. 11). In some implementations, there can be provided a list of known currency items stored in memory of authentication device 20 or a supplemental database as shown in FIG. 11. For example, the fitness value when using LDA can be the sum of the eigen values (i.e. LDA distances) for each axis from the LDA.

In some implementations the output from step 830 can be used as one of the inputs to an optimization step 840 for example, employing a gradient distance algorithm. The optimization step 840 uses as inputs the design constraints from step 800 and how they can be varied, the Maxwell model being used in step 810, and the fitness factor from step 830. The optimization step 840 finds the optimal design parameter that result in the best fitness factor based on the constraints of all the inputs to step 840. For example, when using gradient distance, the algorithm uses the gradient to converge on a solution that optimizes the fitness factor from step 830. In some configurations there may be local maximum found using the optimization step 840 and thus other optimization techniques can be further included to determine if the local maximum found is in fact the true maximum as is commonly known in the arts.

It is contemplated that any combination of design parameters can be fixed and/or varied to establish a new item of currency 5000 as required for a given application. For example, there can be certain design constraints that are known such as manufacturing tolerances, processing of certain materials, and/or manufacturing costs.

In other implementations, the optimization step 840 from FIG. 11 can be omitted and thus a simulation technique for a specified sensing system 25 and a specified item of currency 50 can be used to estimate behavior of an authentication unit 20. This type of implementations can be useful in the design and development of either new items of currency or new authentication devices 20 however this is not intended to be limiting on the disclosure or claims in any way.

In some implementations, the Maxwell model from step 810 requires a direct numerical solution of the Maxwell equations to determine the simulated sensor 60 signals. Such a need arises when the model deduced from the Maxwell equations is open form and/or depending on the particular sensor arrangement.

Figure 10:
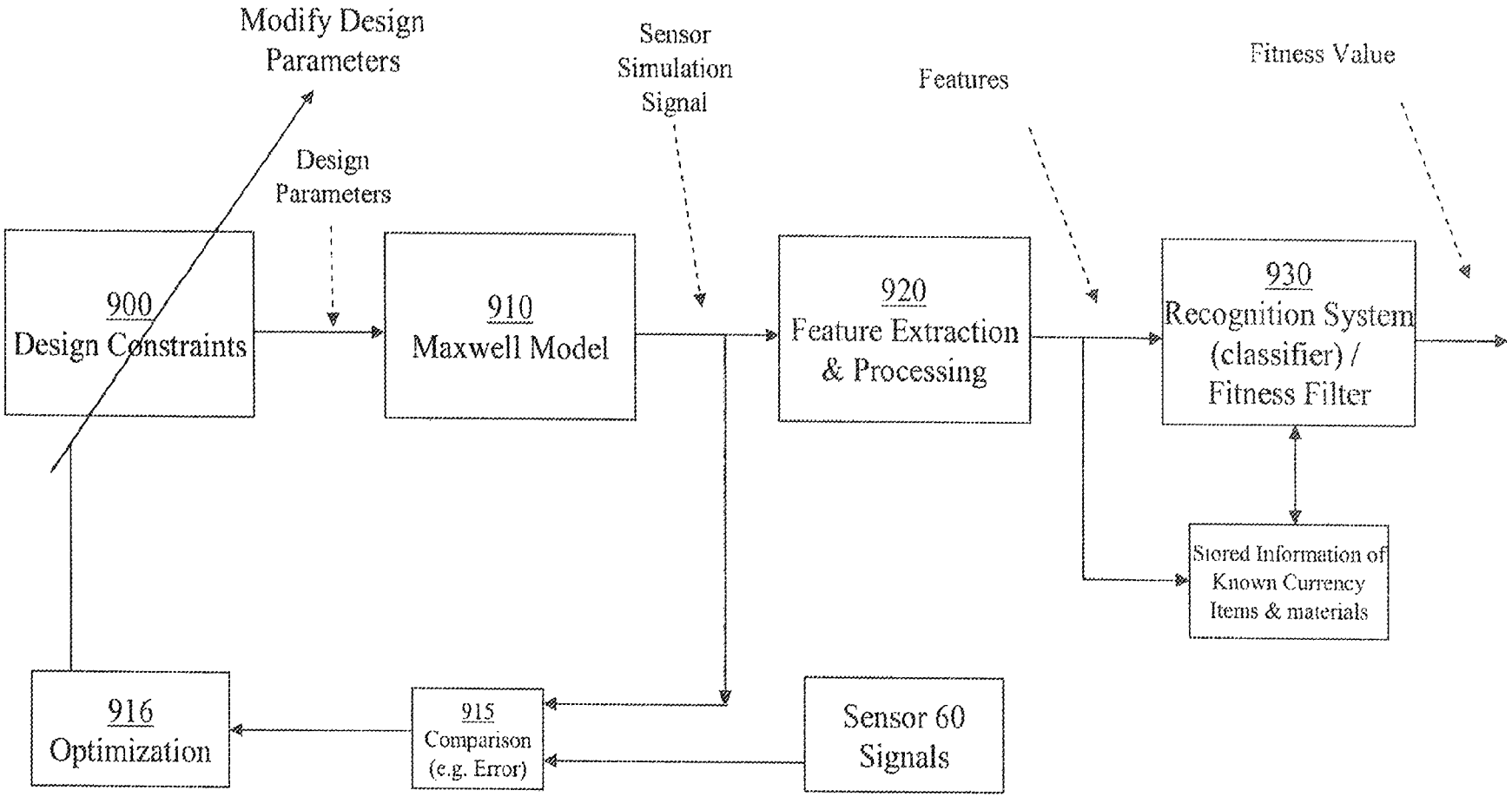
FIG. 10 is a process flow showing various steps of an implementation of the disclosure.

In some implementations, there can be provided a method and apparatus for classifying items of currency as shown in FIG. 10. An authentication device 20 includes a sensing system 25 in which a model can be constructed using the Maxwell equations shown in step 910. In some implementations the model for sensing system 25 does not have a closed form solution and therefore step 910 can be accomplished by numerically solving the Maxwell equations. Authentication device 20 includes a processing unit for performing various computations of the steps shown in FIG. 10.

In some implementations, an item of currency is inserted into currency handling machine 10 and transported to authentication device 20. Sensing system 25 obtains response information from currency item 50 and corresponding signals are obtained from sensor 60. Authentication unit 20, using processor 80, selects an initial set of design parameters in step 900. The initial set of parameters can be selected at random or in a predetermined manner. The design parameters from step 900 are used in step 910 to produce simulated signals for an item of currency having such design parameters. The simulated signals from step 910 and the actual signals from sensor 60 are provided as inputs to step 915 for comparison. For example, the error between the two signals can be computed. The output from step 915 (e.g. computed error) is provided as an input to step 916 where by an optimization (e.g. minimization through gradient distance) is made in order to select new design parameters (or modify the initial ones) to be inputs to step 910. Since in some implementations there is not an existing mathematical inversion of the Maxwell model from step 910, an annealing technique can be implemented to iteratively cycle from between steps 900, 910, 915, and 915 until a desired minimum error (for example) is reached. The design parameters from step 900 that are selected (or identified) by the optimization technique are then used to produce simulated signals to be provided to step 920 as inputs. Step 920 uses feature extraction to select predetermined features from the signals from step 910 and provide them as inputs to step 930. Step 930 is a classification step whereby the inserted currency item 50 is compared with at least one known currency item to determine if it is a member of that class. In some implementations, the step 930 employs a classification technique including, but not limited to, Mahalanobis distance, Linear Discriminant Analysis, Support Vector Machine, and Feature Vector Selection. In some implementations, step 930 is a fitness filter. The output of step 930 provides a fitness value for use in discriminating between at least one known currency item and an inserted item of currency 50. For example, when Mahalanobis Distance is used, inserted currency item can be evaluated for belonging to a certain class if the fitness value obtained from step 930 falls within a predetermined threshold.

What is claimed is:

1. A method for implementation by one or more data processors forming part of at least one computing system comprising:

receiving, by at least one data processor, data characterizing a measured electromagnetic response of at least one component of an item of currency;

simulating, using at least one data processor, the measured electromagnetic response of the at least one component of the item of currency using model parameters describing an electromagnetic response of the at least one component of the item of currency;

updating, using at least one data processor, the model parameters based at least on a difference between the simulated response and the received data;

simulating, using at least one data processor, the measured electromagnetic response of the at least one component of the item of currency using the updated model parameters to create a second simulated signal of the at least one component of the item of currency; and classifying, using at least one data processor, the item of currency based on the second simulated signal of the at least one component of the item of currency.

2. The method according to claim 1 wherein a classification algorithm is used to classify the item of currency, the classification algorithm being selected from the group consisting of; Mahalanobis Distance, Feature Vector Selection, and Linear Discriminant Analysis.

3. The method of claim 1 wherein the characterization of the at least one component is a characterization of a complex impedance of the at least one component.

4. The method according to claim 1 wherein the measured electromagnetic response is measured using a sensor that includes a coil.

5. The method according to claim 1 wherein the item of currency is comprised of at least two electromagnetic components.

6. The method according to claim 1 wherein the item of currency is a coin.

7. The method according to claim 1 wherein the item of currency is a valuable document.

8. The method according to claim 1 wherein the simulated signal is an estimation of the complex impedance of the item of currency.

9. The method according to claim 3 wherein the complex impedance is derived from the Maxwell Equations.

10. The method according to claim 1 further comprising:

computing a fitness value; and computing a comparison of the fitness value and a predetermined threshold.

11. The method according to claim 1, further comprising:

estimating a structure of the item of currency.

12. The method according to claim 11, wherein the structure of the item of currency includes one or more of: material of the item of currency, and number of layers of the item of currency.

13. A system comprising:

at least one data processor;

memory storing instructions which, when executed by the at least one data processor, causes the at least one data processor to perform operations comprising:

receiving data characterizing a measured electromagnetic response of at least one component of an item of currency;

simulating the measured electromagnetic response of the at least one component of the item of currency using model parameters describing an electromagnetic response of the at least one component of the item of currency;

updating the model parameters based at least on a difference between the simulated response and the received data;

simulating, using at least one data processor, the measured electromagnetic response of the at least one component of the item of currency using the updated model parameters to create a second simulated signal of the at least one component of the item of currency; and classifying, using at least one data processor, the item of currency based on the second simulated signal of the at least one component of the item of currency.

* * * * *